US007073300B1

(12) United States Patent
Sohns

(10) Patent No.: US 7,073,300 B1
(45) Date of Patent: Jul. 11, 2006

(54) REINFORCED CONCRETE PART FOR PRODUCING FOUNDATIONS OF BUILDINGS

(76) Inventor: Udo Sohns, Zurn Marshall 20, 54608 Brandscheid (DE)

( * ) Notice: Subject to any disclaimer, the term of this patent is extended or adjusted under 35 U.S.C. 154(b) by 0 days.

(21) Appl. No.: 10/070,116

(22) PCT Filed: Aug. 29, 2000

(86) PCT No.: PCT/EP00/08422

§ 371 (c)(1),
(2), (4) Date: Feb. 27, 2002

(87) PCT Pub. No.: WO01/16441

PCT Pub. Date: Mar. 8, 2001

(30) Foreign Application Priority Data

Sep. 1, 1999 (DE) ..... 199 41 603

(51) Int. Cl.
*E04B 2/00* (2006.01)

(52) U.S. Cl. ..... 52/426; 52/565; 52/431; 52/379; 52/430; 52/586.1; 52/562; 52/571

(58) Field of Classification Search ..... 52/424, 52/426, 428, 431, 379, 427, 430, 586.1, 565, 52/562, 425, 432, 442, 563
See application file for complete search history.

(56) References Cited

U.S. PATENT DOCUMENTS

| | | | | | |
|---|---|---|---|---|---|
| 3,321,884 | A | * | 5/1967 | Klaue | 52/565 |
| 3,768,225 | A | * | 10/1973 | Sloan | 52/742.14 |
| 4,773,199 | A | * | 9/1988 | Kohara | 52/426 |
| 5,611,183 | A | * | 3/1997 | Kim | 52/426 |
| 5,771,648 | A | * | 6/1998 | Miller et al. | 52/309.7 |
| 5,802,793 | A | * | 9/1998 | DeVore, Jr. | 52/424 |
| 5,887,401 | A | * | 3/1999 | Moore, Jr. | 52/426 |
| 6,070,380 | A | * | 6/2000 | Meilleur | 52/309.7 |
| 6,167,671 | B1 | * | 1/2001 | Wilson | 52/654.1 |

FOREIGN PATENT DOCUMENTS

| | | | | |
|---|---|---|---|---|
| DE | 2242202 | A | * | 3/1974 |
| DE | 195 20 082 | A1 | | 12/1996 |
| DE | 196 09 496 | A1 | | 9/1997 |
| DE | 19808509 | C1 | * | 8/1999 |
| EP | 90303 | A2 | * | 10/1983 |
| GB | 176868 | | * | 3/1922 |
| JP | 4-166518 | A | | 6/1992 |

* cited by examiner

*Primary Examiner*—Carl D. Friedman
*Assistant Examiner*—Chi Q. Nguyen
(74) *Attorney, Agent, or Firm*—Thorpe North & Western

(57) ABSTRACT

The invention relates to a reinforced concrete section (1, 23, 26–28) comprising two commercially available pre-cast floor elements (2, 3) of the same type. Each element consists of a substantially rectangular concrete slab (4, 21) and at least one lattice girder (5, 7) attached thereto. The two pre-cast floor elements are arranged in a laterally reversed manner so that their concrete slabs (4, 21) are situated parallel to and at a distance from each other and their lattice girders face one another. The pre-cast floor elements (2, 3) are fixedly attached to one another by their lattice girders (5–7). The reinforced concrete section (1, 23, 26–28) can be used with site-mixed concrete to rapidly produce a foundation for a building on the building site, without erecting the shuttering and dismantling the shuttering.

7 Claims, 4 Drawing Sheets

18
8
11
1
2
21
3
15
4
14
16
17
19
22
20
13
10
7

REINFORCED CONCRETE PART FOR PRODUCING FOUNDATIONS OF BUILDINGS

BACKGROUND OF THE INVENTION

1. Field

The invention relates to a reinforced concrete section for producing foundations for buildings.

2. State of the Art

In the foundation constructions which are generally known, a reinforcement and shuttering walls are usually provided (erection of shuttering). After they have been filled with site-mixed concrete, the shuttering walls are removed again (dismantling of shuttering), while the reinforcement remains in the concrete. This method has the disadvantage that the production of a foundation on site is a very time-consuming or labor-intensive operation.

SUMMARY OF THE INVENTION

Compared with the prior art, the underlying object of the present invention is therefore to create a building component which functions both as a reinforcement and as shuttering walls, which enables a building foundation rapidly and reliably to be erected on site using site-mixed concrete, and which in addition can be produced in a simple and inexpensive manner.

This object is achieved according to the invention for a reinforced concrete section of the type in question in that the reinforced concrete section consists of two commercially available pre-cast floor elements of the same type, which each comprise a substantially rectangular concrete slab and at least one lattice girder made of steel which is attached thereto, that the two pre-cast floor elements are arranged in a laterally reversed manner so that their concrete slabs are situated parallel to and at a distance from each other and their lattice girders face one another, and that the lattice girders are fixedly attached to one another.

The main advantage of the reinforced concrete section according to the invention is that the operations of erecting the shuttering and dismantling the shuttering which were mentioned at the outset are dispensed with, which results in enormous savings in time or labor on the building site.

The finished reinforced concrete sections which are intended for a foundation are brought to the building site and are simply arranged in the requisite manner there. This can be effected very rapidly by means of a corresponding laying plan. Because each reinforced concrete section which is provided for the foundation is placed on two longitudinal edges of its concrete slabs on site, the concrete slabs form sidewalls between which site-mixed concrete can be introduced. The reinforced concrete sections can then immediately be filled with site-mixed concrete. After the concrete has set, the foundation is finished and the building can be erected on the foundation. Foundations of very different types can be produced with the reinforced concrete section (e.g. continuous footings, pile foundations, separate foundations, etc). The size and geometric relationships of the reinforced concrete section according to the invention and of the individual elements thereof depend on the static loading requirements with regard to the building concerned which is to stand on the foundation.

Another significant advantage of the reinforced concrete section is that commercially available pre-cast floor elements can be used for the production thereof. The basic construction of pre-cast floor elements such as these, which have hitherto solely been provided for the production of floors, are given, for example, in the leaflet entitled "Slab Floor Laying Instructions" published by Badische Drahtwerke GmbH of Kehl/Rhein (Germany).

Accordingly, a pre-cast floor element basically consists of a concrete slab, which is generally rectangular, and of at least one steel lattice girder which is attached thereto. Pre-cast floor elements which are intended for a floor, for example a floor between storeys, are disposed in a known manner and according to a defined laying plan on the building site so that their concrete slabs are at the bottom with their flat undersides facing downwards, while the lattice girders thereof face upwards. After laying the pre-cast floor elements, the floor as a whole can be filled with site-mixed concrete. The finished floor is comparable with a solid floor made of solid concrete. The difference is that the finished floor does not subsequently have to be plastered. It is sufficient to clean up or level out the joint gaps in the pre-cast floor elements after concreting, for example.

The lattice girder of a commercially available pre-cast floor element, which protrudes vertically from the concrete slab, generally comprises at least one top boom, a bottom boom which extends parallel to the top boom at a distance corresponding to the height of the lattice girder, and diagonal sections or diagonals which join the top and bottom booms. During production, the bottom boom is cast in the concrete slab and is therefore no longer visible in the finished pre-cast floor element. The diagonal sections or diagonals serve to withstand the shear forces which occur in the joint between the pre-cast floor element and the site-mixed concrete. The top and bottom booms provide the necessary stiffness of the pre-cast floor elements when they are installed.

The use of commercially available pre-cast floor elements for producing the reinforced concrete sections according to the invention results in a cost saving, since these pre-cast floor elements as such are very inexpensive to manufacture. Although these pre-cast floor elements have hitherto only been used for the production of floors, they are very suitable for the production and for the safe use of the reinforced concrete section according to the invention.

Advantageous embodiments of the reinforced concrete section according to the invention.

The present invention also relates to a foundation for buildings which is produced using reinforced concrete sections according to the invention, wherein in said foundation the reinforced concrete sections are situated in a position in which they are standing on two of their longitudinal edges and the space between the concrete slabs of the reinforced concrete sections is filled with site-mixed concrete. In this manner, it is possible to create as many forms of foundations as are required for the building concerned.

BRIEF DESCRIPTION OF THE ILLUSTRATED EMBODIMENTS

The invention is explained in greater detail below with reference to the schematic drawings, where:

DETAILED DESCRIPTION OF THE ILLUSTRATED EMBODIMENTS

Figure 1:
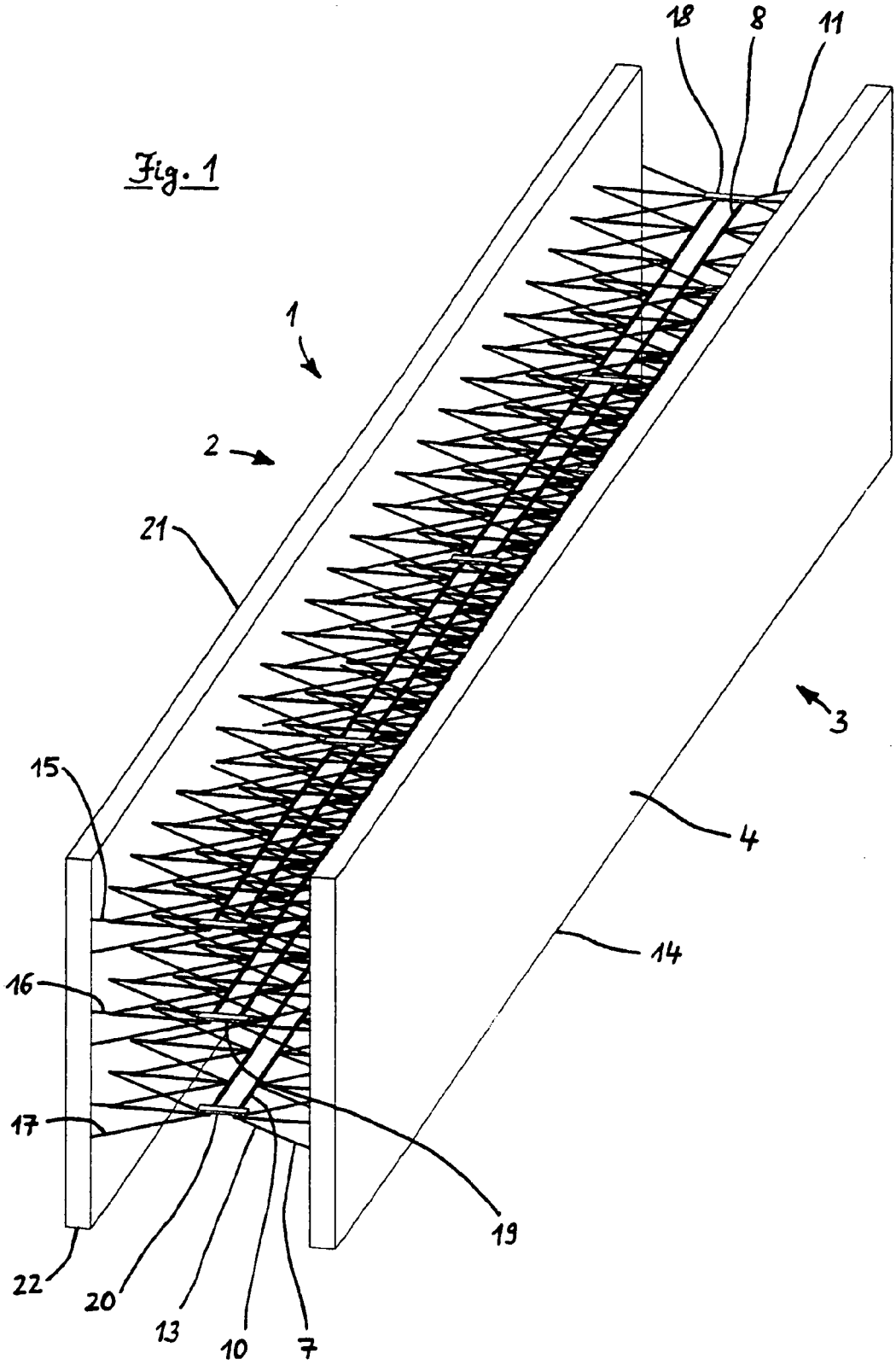
FIG. 1 is a perspective view from above of an embodiment of a reinforced concrete section according to the invention.

The reinforced concrete section 1 shown in FIG. 1 consists of two identical pre-cast floor elements 2 and 3 which are fixedly attached to each other, and is employed for the production of building foundations. The pre-cast floor element 3 is illustrated in FIGS. 2 and 3 as a component part, and is produced commercially.

The pre-cast floor element 3 consists of a rectangular concrete slab 4 of defined thickness, and of three steel lattice girders 5–7 (lattice girder type KT) which are fixedly attached to the concrete slab and which protrude vertically therefrom. The lattice girders 5 and 7 are parallel to and are disposed at the same distance from lattice girder 6. They each comprise a top boom 8–10, two bottom booms which extend parallel to and at a distance from the associated top boom corresponding to the height of the lattice girder, and diagonal sections or diagonals 11–13 connecting the top booms 8–10 and bottom booms. The bottom booms of a lattice girder 5–7, which are present in pairs, are cast into the concrete slab 4 during the production of the pre-cast floor element 3, and therefore cannot be seen in FIGS. 1–3. The diagonals 11–13 are also disposed in pairs. In the case of the lattice girder 7, for example, this means that two diagonally extending lattice girder rods 13*a*, 13*b* of the diagonals 13 of the respective parallel bottom booms converge towards the top boom 10 (FIG. 2).

Figure 2:
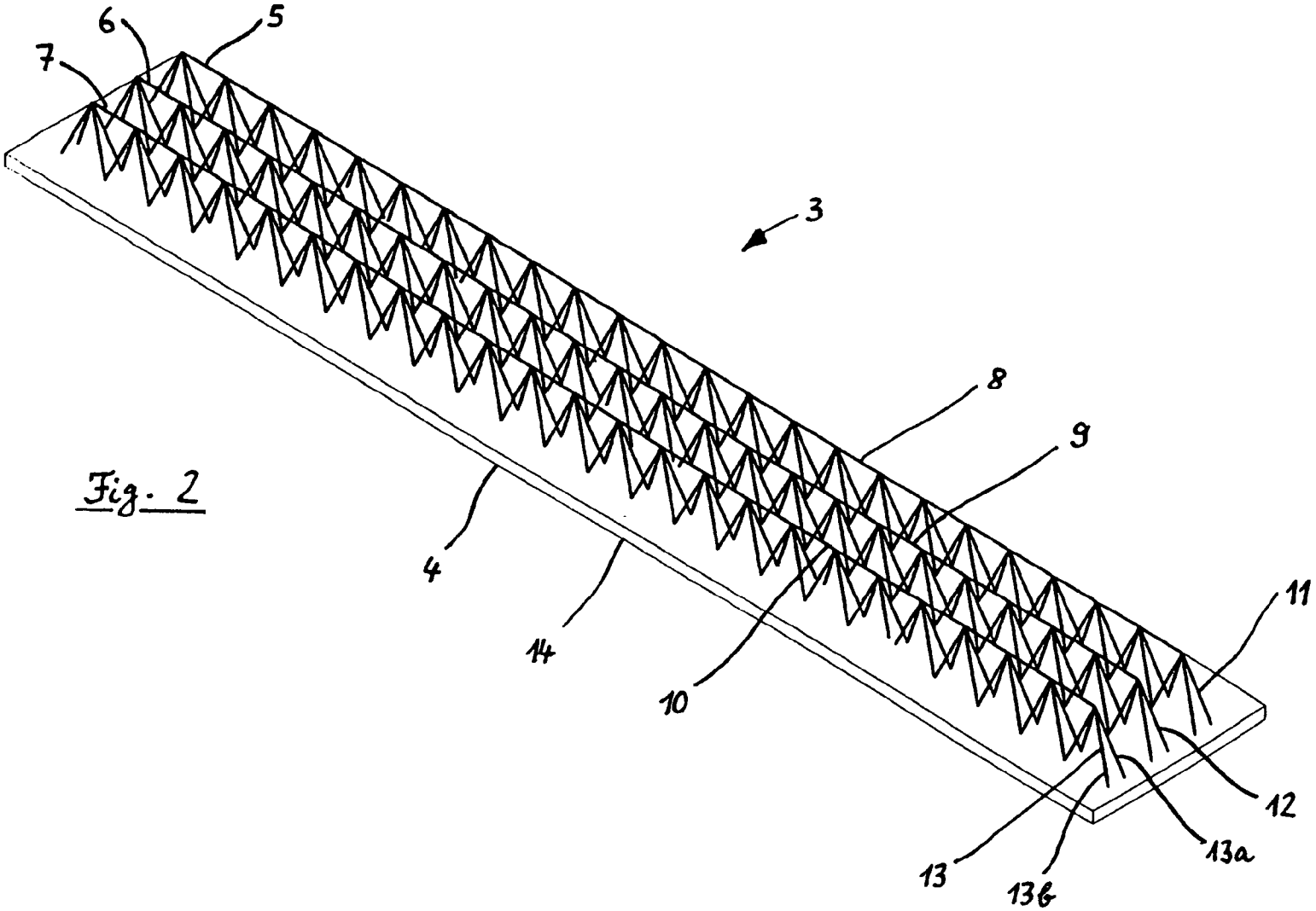
FIG. 2 shows a pre-cast floor element which is provided for the reinforced concrete section shown in FIG. 1, in a position in which it is laid flat.
Figure 3:
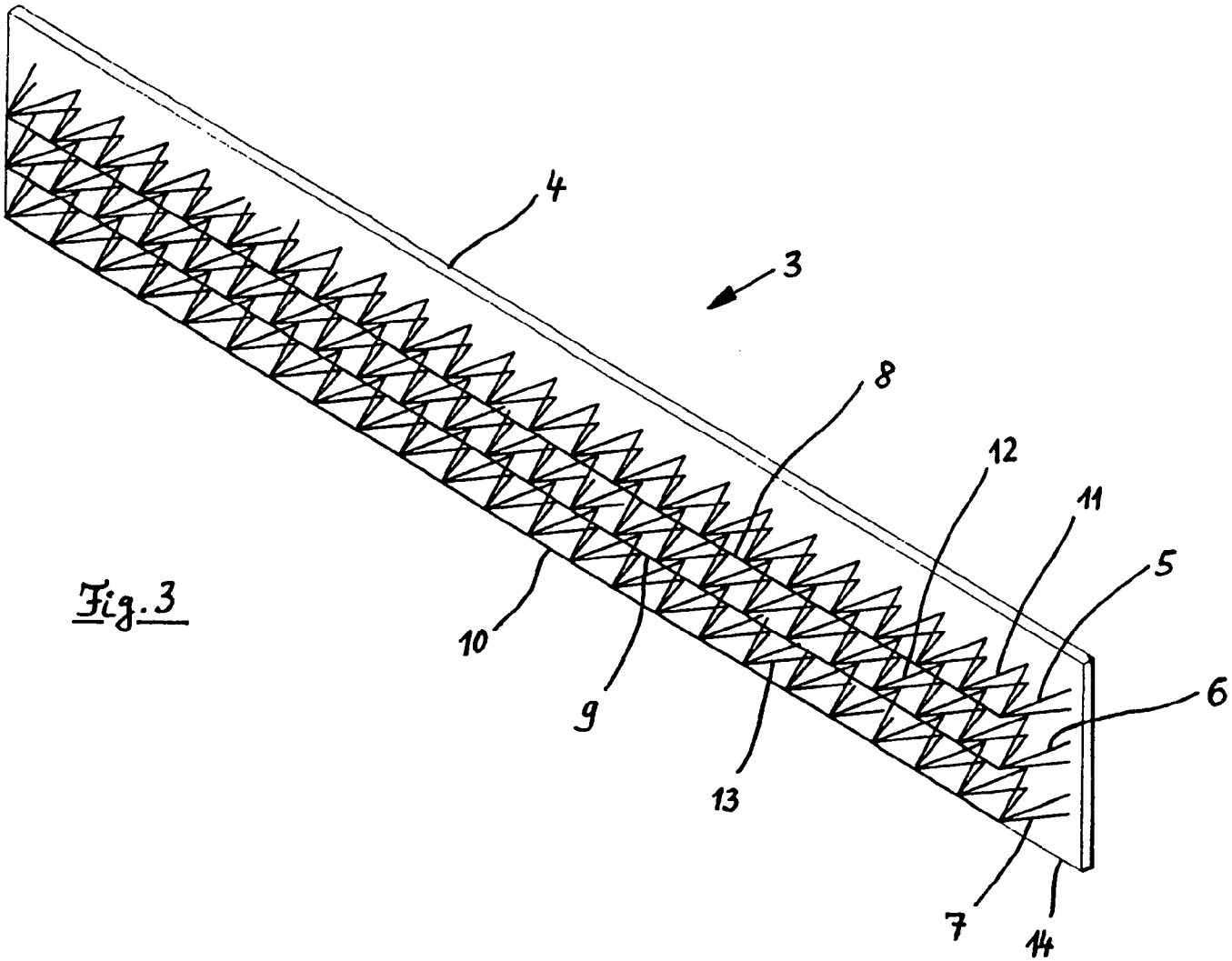
FIG. 3 shows the pre-cast floor element of FIG. 2 in a position in which it is turned upwards by 90°.

FIG. 2 shows the pre-cast floor element 3 in the situation in which pre-cast floor elements of a commercially available type such as these have hitherto been laid for the production of floors, of floors between storeys for example. The concrete slab 4 lies flat or horizontally and the lattice girders 5–7 face upwards, so that liquid site-mixed concrete can be introduced from above. If the same pre-cast floor element 3 is rotated anti-clockwise by an angle of 90° about its longitudinal centre line, it reaches the position shown in FIG. 3. Consequently, it is "up-ended" on the lower longitudinal edge 14 of its concrete slab 4.

The two pre-cast floor elements 2 and 3 shown in FIG. 1 are up-ended in the aforementioned manner and are disposed laterally reversed in relation to each other. Their lattice girders 5–7 and 15–17, namely the lattice girders 5–7 of the right pre-cast floor element 3 and the lattice girders 15–17 of the left pre-cast floor element 2, respectively, which are each opposite each other at the same height or which face each other, are fixedly attached to each other by transition pieces 18–20 which are formed as flat rods (welded joint). The flat rods or transition pieces 18–20 are somewhat longer than the distance between the top booms 8–10, which are adjacent in pairs, of lattice girders 5–7 and 15–17. The number and length of the flat rods or transition pieces 18–20 depends in particular on the specific geometry of the pre-cast floor elements 2, 3 and of their lattice girders 5–7 and 15–17, and on the particular mechanical demands which are imposed thereon or which are imposed on the foundation which is to be constructed therewith.

The concrete slab 4 of the right pre-cast floor element 3 and the concrete slab 21 of the left pre-cast floor element 2 are situated parallel to and at a distance from each other, and form the shuttering walls, as it were, of the reinforced concrete section 1. The reinforced concrete section 1 stands on the bottom longitudinal edge 14 of the concrete slab 4 of the right pre-cast floor element 3 and on the bottom longitudinal edge 22 of the concrete slab 21 of the left pre-cast floor element 2. In this situation, reinforced concrete sections such as reinforced concrete section 1 are erected on site according to a defined laying plan. They are then filled with site-mixed concrete from above, which thus takes up the entire free space between the concrete slabs 4 and 21. Together with the concrete slabs 4 and 21 and with the site-mixed concrete, the lattice girders 5–7 and 15–17 ensure the requisite mechanical strength or stability of the reinforced concrete section 1 and of the building foundation which is constructed therewith.

Figure 4:
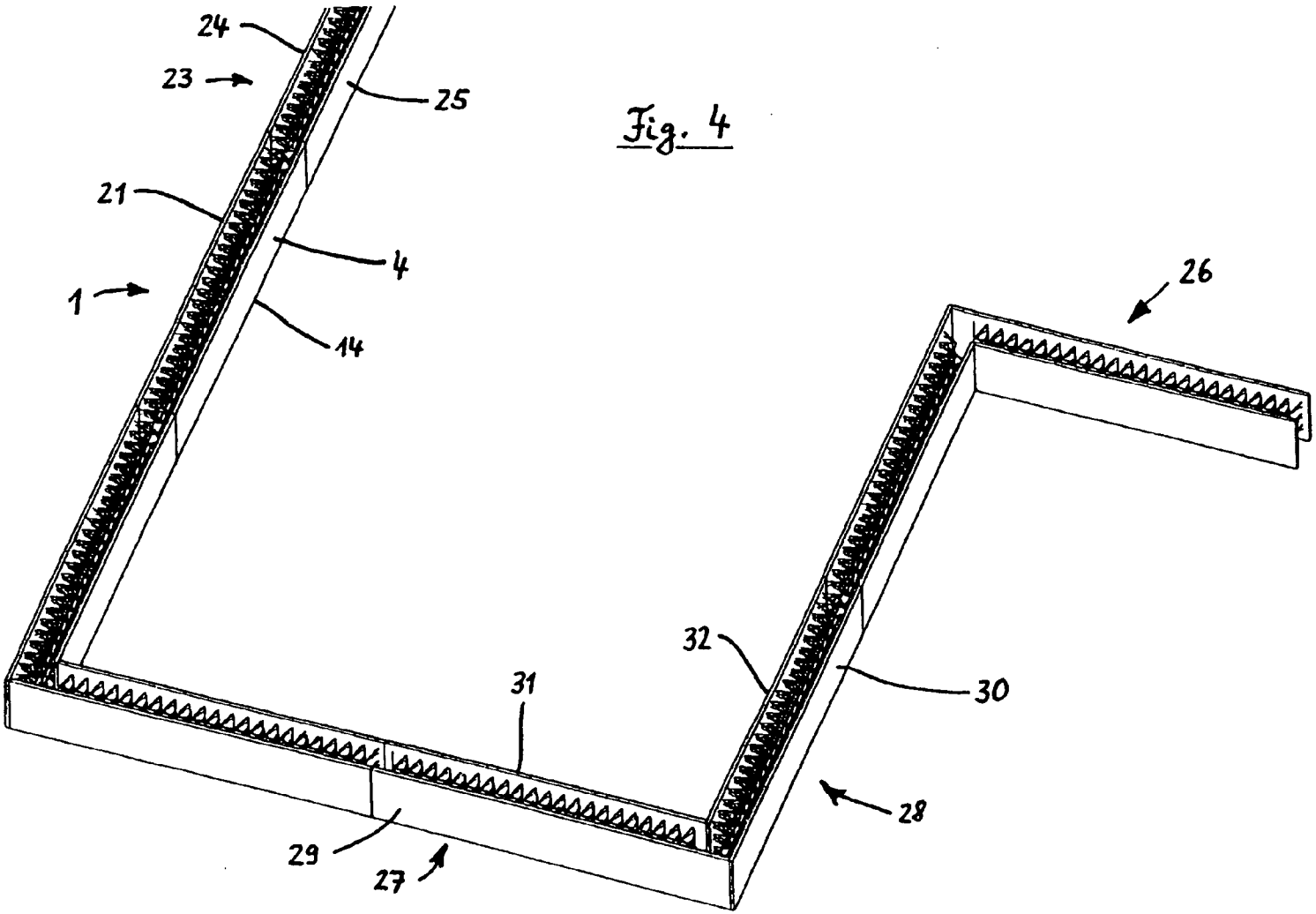
FIG. 4 is a perspective view from above of part of a building foundation according to the invention, which is produced using reinforced concrete sections according to the invention, before it is filled with site-mixed concrete.

A portion of a foundation such as this is shown in FIG. 4. The reinforced concrete section 1 is provided there on a site. Each open lateral end of the reinforced concrete section 1 is adjoined by the next reinforced concrete section, for example reinforced concrete section 23, which in principle is constructed and disposed in exactly the same way as reinforced concrete section 1. The concrete slabs 24 and 25 of reinforced concrete section 23 are of the same thickness as the concrete slabs 4 and 21 of reinforced concrete section 1, and are parallel to each other at the same distance. The abutting reinforced concrete sections 1 and 23, which stand on their bottom longitudinal edges 14, 22, therefore adjoin and are flush with each other and form a foundation channel, as it were, which can be filled with site-mixed concrete. If the reinforced concrete sections which are provided for a foundation are arranged in the form of a closed ring-like arrangement, they can be concreted immediately without further measures. If a reinforced concrete section—for example reinforced concrete section 26—has a free end which is not adjoined by another reinforced concrete section, a shuttering wall has to be provided at the open lateral end.

FIG. 4 illustrates the situation in which two reinforced concrete sections 27, 28 are disposed at right angles to each other. In this situation, the outer concrete slabs 29, 30 thereof are longer than the inner concrete slabs 31, 32 thereof; this requires no further explanation.

Finally, it should be remarked in connection with FIG. 4 that the region between reinforced concrete sections 1, 23, 27, 28, or at the side near these sections can be filled with soil.

I claim:

1. A foundation for buildings, comprising:

a plurality of reinforced concrete sections, each reinforced concrete section comprising:

two pre-cast floor elements each comprising a substantially rectangular concrete slab and at least one lattice girder made of steel attached to the concrete slab, said lattice girder having a top boom spaced from the concrete slab, the two pre-cast floor elements arranged in a laterally reversed manner so that their concrete slabs are situated parallel to and at a distance from one another and their lattice girders face one another; and at least one transition piece extending rigidly and substantially horizontally between the top booms of the facing lattice girders to thereby rigidly attach the two pre-cast floor elements to one another to form a single prefabricated part;

wherein the rectangular concrete slabs each have a pair of opposite longitudinal edges giving each reinforced concrete section four longitudinal edges;

wherein the plurality of reinforced concrete sections are situated in a position in which they are each standing on two of their longitudinal edges and each section substantially abuts another of the sections; and the space between the concrete slabs of the reinforced concrete sections is filled with site-mixed concrete.

2. A reinforced concrete section for producing foundations for buildings, comprising:

two pre-cast floor elements each comprising a substantially rectangular concrete slab and at least one lattice girder made of steel attached to the concrete slab, said lattice girder having a top boom spaced from the concrete slab, the two pre-cast floor elements arranged in a laterally reversed manner so that their concrete slabs are situated parallel to and at a distance from one another and their lattice girders face one another, and at least one transition piece extending rigidly and substantially horizontally between the top booms of the facing lattice girders to thereby rigidly attach the two pre-cast floor elements to one another to form a single prefabricated part.

3. A reinforced concrete section according to claim 2, wherein the at least one transition piece is welded to each lattice girder top boom.

4. A reinforced concrete section according to claim 3, wherein the at least one transition piece is a flat rod or a round rod.

5. A method of forming a foundation for buildings, comprising the steps of:

obtaining a plurality of reinforced concrete sections wherein each reinforced concrete section comprises two pre-cast floor elements each comprising a substantially rectangular concrete slab having a pair of opposite longitudinal edges and at least one lattice girder made of steel attached to the concrete slab, said lattice girder having a top boom spaced from the concrete slab, the two pre-cast floor elements arranged in a laterally reversed manner so that their concrete slabs are situated parallel to and at a distance from one another and their lattice girders face one another, and at least one transition piece extending rigidly and substantially horizontally between the top booms of the facing lattice girders to thereby rigidly attach the two pre-cast floor elements to one another to form a single prefabricated part having four longitudinal edges;

arranging the plurality of reinforced concrete sections with each section standing on two of its longitudinal edges and with each section substantially abutting at least one other section to form a foundation channel; and filling the foundation channel with site mixed concrete to form the building foundation.

6. A foundation for buildings according to claim 1, wherein the at least one transition piece is welded to each lattice girder top boom.

7. A foundation for buildings according to claim 6, wherein the at least one transition piece is a flat rod or a round rod.

* * * * *